US009759492B2

(12) United States Patent
Kerler et al.

(10) Patent No.: US 9,759,492 B2
(45) Date of Patent: Sep. 12, 2017

(54) HEAT EXCHANGER HAVING ADDITIONAL REFRIGERANT CHANNEL

(75) Inventors: Boris Kerler, Stuttgart (DE); Wolfgang Seewald, Stuttgart (DE); Markus Ruehl, Bad Schoenborn (DE); Christoph Walter, Stuttgart (DE); Karl-Heinz Staffa, Stuttgart (DE); Michael Geiger, Bad Friedrichshall (DE); Michael Kranich, Besigheim (DE); Ingo Geiger, Freiberg (DE); Wolfgang Geiger, Ludwigsburg (DE); Alexander Satrapa, Sindelfingen (DE)

(73) Assignee: MAHLE International GmbH, Stuttgart (DE)

( * ) Notice: Subject to any disclaimer, the term of this patent is extended or adjusted under 35 U.S.C. 154(b) by 1630 days.

(21) Appl. No.: 12/619,566

(22) Filed: Nov. 16, 2009

(65) Prior Publication Data

US 2010/0116474 A1 May 13, 2010

Related U.S. Application Data

(63) Continuation of application No. PCT/EP2008/003784, filed on May 9, 2008.

(30) Foreign Application Priority Data

May 22, 2007 (DE) ..... 10 2007 024 089
Nov. 13, 2007 (DE) ..... 10 2007 054 481

(51) Int. Cl.
*F28D 1/00* (2006.01)
*F28D 1/053* (2006.01)
(Continued)

(52) U.S. Cl.
CPC ..... *F28D 1/05391* (2013.01); *F25B 39/022* (2013.01); *F25B 39/028* (2013.01);
(Continued)

(58) Field of Classification Search
CPC ..... F28D 1/05391; F28F 9/0229
(Continued)

(56) References Cited

U.S. PATENT DOCUMENTS 1,684,083 A * 9/1928 Bloom ..... F25B 39/02 165/174
5,172,761 A * 12/1992 Lyon ..... F28D 1/05366 165/173
(Continued)

FOREIGN PATENT DOCUMENTS

CN 1266977 A 9/2000
CN 1620589 A1 5/2005
(Continued)

*Primary Examiner* — Devon Russell
(74) *Attorney, Agent, or Firm* — Muncy, Geissler, Olds & Lowe, P.C.

(57) ABSTRACT

A heat exchanger, particularly for a heating or air conditioning system for motor vehicles, includes at least one inlet channel and at least one outlet channel and at least one collector, which has at least two metal sheets or plates abutting each other, and a flow device through which a first medium can flow, while a second medium can flow around the flow device. The first medium is distributed by an inlet channel to the collector and to the flow device and can be conducted to an outlet channel, and at least one further channel for distributing the coolant is provided, which is connected in a communicating manner via at least one opening to the inlet channel.

18 Claims, 21 Drawing Sheets

(51) Int. Cl.
*F25B 39/02* (2006.01)
*F28F 9/02* (2006.01)
*F28D 21/00* (2006.01)

(52) U.S. Cl.
CPC ..... *F28F 9/0229* (2013.01); *F28F 9/0273* (2013.01); *F28F 9/0278* (2013.01); *F28D 2021/0085* (2013.01)

(58) Field of Classification Search
USPC ..... 165/174
See application file for complete search history.

(56) References Cited

U.S. PATENT DOCUMENTS 5,203,407 A 4/1993 Nagasaka
5,910,167 A * 6/1999 Reinke ..... F25B 39/028 165/174
7,331,195 B2 * 2/2008 Bae ..... F25B 39/02 165/174
7,481,266 B2 * 1/2009 Demuth et al. ..... 165/176
7,775,067 B2 * 8/2010 Ichiyanagi ..... F25B 39/00 165/173
8,776,873 B2 * 7/2014 Mross ..... F28D 1/05391 165/173
D724,190 S * 3/2015 Mross ..... D23/323
9,291,407 B2 * 3/2016 Huazhao ..... F25B 39/028
2003/0150603 A1 8/2003 Auchter et al.
2004/0026072 A1 2/2004 Yi et al.
2005/0006073 A1 1/2005 Demuth et al.
2005/0039901 A1 * 2/2005 Demuth ..... F28D 1/0478 165/175
2005/0103486 A1 * 5/2005 Demuth et al. ..... 165/174
2005/0284621 A1 12/2005 Katoh et al.
2007/0256821 A1 11/2007 Mashiko et al.
2010/0089559 A1 * 4/2010 Gorbounov ..... F25B 39/028 165/174
2014/0096944 A1 * 4/2014 Seo ..... F28F 9/0204 165/174

FOREIGN PATENT DOCUMENTS

DE 27 03 528 A1 8/1978
DE 199 26 990 A1 12/1999
DE 102 60 030 A1 7/2003
DE 10 2006 046 671 A1 4/2008
EP 1 300 646 A2 4/2003
WO WO 2005/088219 A1 9/2005
WO WO 2006/083426 A1 8/2006
WO WO 2006/083443 A2 8/2006

* cited by examiner 2
23
4

4
2
19

4
2
4
2
21
19
F
XIV
XIV
F 21
2
19
F
XVI
XVI
F 4
2
21
19
F
XVIII
XVIII
F

HEAT EXCHANGER HAVING ADDITIONAL REFRIGERANT CHANNEL

This nonprovisional application is a continuation of International Application No. PCT/EP2008/003784, which was filed on May 9, 2008, and which claims priority to German Patent Application No. 10 2007 024 089.0, which was filed in Germany on May 22, 2007, and to German Patent Application No. 10 2007 054 481.4, which was filed in Germany on Nov. 13, 2007, and which are all herein incorporated by reference.

BACKGROUND OF THE INVENTION

Field of the Invention

The invention relates to a heat exchanger, particularly an evaporator, as it used particularly for a heating or air conditioning system for motor vehicles.

Description of the Background Art

Evaporators are known in which the two-phase refrigerant is distributed from an inlet channel to a flow device, preferably tubes, especially flat tubes. After flowing through the flat tubes, the vaporous refrigerant leaves the evaporator via an outlet channel.

In this regard, the uniform distribution of the liquid refrigerant along the entire length of the inlet channel causes difficulties. The reason for this, among others, is the formation of different flow forms as a function of the operational state. Furthermore, the segregation of the two-phase refrigerant mixture, which is homogeneous when entering the evaporator, along the length of the inlet channel also plays a special role. Individual tubes are therefore supplied solely with refrigerant vapors, as a result of which the evaporator performance worsens.

FIG. 1 shows a heat exchanger 1, particularly an evaporator for a motor vehicle air conditioning system according to the conventional art, and hereby particularly the flow course of the refrigerant. A heat exchanger of this type has an inlet channel 2, through which the refrigerant is supplied to the heat exchanger from a refrigerant circuit (not shown), via an inlet opening 18 (indicated by arrow A). Inlet channel 2 is formed elongated and is terminated by two ends.

Further, heat exchanger 1 has a collector 12, which includes an injection plate 5, a distribution plate 6, and a bottom plate 7. The refrigerant is supplied via this collector to a flow device 8, preferably flat tubes.

Between the tubes, heat conducting fins are arranged around which a medium, preferably air L (indicated by an arrow), can flow.

The tubes and the holes in bottom plate 7 are divided in the middle by a bar (not shown), so that two flow regions 14 and 15 are formed, through which the refrigerant flows in an opposite direction.

The refrigerant therefore flows first, following the arrow B, through a flow region 14, is then deflected through an intermediate chamber 13, which includes a bottom plate 9, a deflection plate 10, and an end plate 11, following the arrow C, and flows through a flow region 15 in the opposite direction, following the arrow D, into collector 12. Preferably, flow region 15 faces the incoming air L.

A plurality of injection holes 16 are provided in injection plate 5 of collector 12, so that the refrigerant can flow into flow region 14 from inlet channel 2 via openings (not shown), which correspond to injection holes 16. Furthermore, intake holes 17 are provided in injection plate 2, so that the refrigerant can flow in from flow region 15 into outlet channel 3. Via outlet channel 3, the refrigerant then enters a refrigerant circuit (not shown) (indicated by arrow E).

An evaporator of this type according to the invention is called an evaporator with deflection depth-wise.

FIG. 1*b* shows another evaporator according to the prior art. An evaporator of this type differs from the evaporator shown in FIG. 1*a* particularly in the conduct of the refrigerant in flow device 8. According to FIG. 1*b*, injection holes 16 and intake holes 17 are arranged offset in the injection plate. The refrigerant therefore flows first in the inlet channel (indicated by arrow A), is subsequently distributed via injection holes 16 to the flow device, and following arrows B and C reaches the outlet channel through the intake holes, and flows out of the evaporator following arrow D. An evaporator of this type according to the invention is called an evaporator with a deflection width-wise.

Evaporators of this type, however, leave something to be desired in regard to a uniform distribution of the liquid refrigerant to all flat tubes.

SUMMARY OF THE INVENTION

It is therefore an object of the present invention to provide an improved evaporator, whereby the most uniform distribution possible of the liquid refrigerant to all flat tubes is achieved and segregation of the two-phase refrigerant is effectively reduced.

In an embodiment of the invention, a heat exchanger is provided having at least one inlet channel and at least one outlet channel and at least one collector, which has at least two adjacent metal sheets, and having a flow device, through which a first medium can flow and around which a second medium can flow, whereby the first medium is distributed from an inlet channel to the collector and to the flow device and can be conducted to an outlet channel, whereby at least one additional channel is provided for the distribution of the refrigerant, which is connected to the inlet channel in a communicating manner via at least one opening.

The distribution path length of the refrigerant to the flow device can be shortened by the at least one additional channel and thereby minimizes the possibility of phase separation of the refrigerant or an unequal supply of the flow device with refrigerant. As a result, the evaporator performance is effectively increased.

A channel within the meaning of the invention is taken to mean not only a flow path for the refrigerant, but also the material limitation of the flow path, for example, by a tube.

Furthermore, the extension of the heat exchanger lengthwise according to the invention is to be understood as the depth and the extension of the heat exchanger transverse to the main flow direction of the second medium is to be understood as the width.

The collector has at least two metal sheets or plates, which are connected to one another form-fittingly and/or by material bonding, for example, by soldering, welding, TOX clinching, riveting, caulking, or a combination of said types of connection. In another embodiment, the at least two metal sheets are connected together by a hinge.

In an embodiment, the collector includes two metal sheets, which are produced by a deep-drawing method. The deep-drawing profiles in the opposite direction have chamber-like convex areas, in which the refrigerant is distributed to the flow device. The two metal sheets can be produced directly in a single tool. This is possible because both collector halves are very similar or have the same chamber geometries. As a result of this embodiment, a series of advantages are achieved in comparison with collectors with three plates according to the conventional art: reduction of the number of collector parts; thinner and uniform wall thicknesses in the deep-drawing profiles in comparison with plates; less assembly work; and lower weight and lower costs associated therewith.

The flow device can include tubes through which the refrigerant flows. The tubes in this case can have a circular, oval, substantially rectangular, or any other cross section. For example, the tubes are formed as flat tubes. To increase the heat exchange, optionally fins, particularly corrugated fins, are arranged between the tubes, whereby the tubes and the fins are in particular soldered to one another. According to the invention, the tubes and the fins soldered to the tubes are called an evaporator network. In this respect, an evaporator network has 50 flat tubes.

In another embodiment of the invention, the additional channel can be arranged within the inlet channel. The additional channel is provided with at least one, preferably two or more openings, which connect the additional channel to the inlet channel in a communicating manner. Preferably, the two openings are arranged on opposite sides of the additional channel and in a direction that is substantially perpendicular to the evaporator network plane and/or in a direction that is substantially parallel to the evaporator network plane and perpendicular to the axis of the inlet channel. Preferably, the at least one, preferably two openings are arranged in the middle of the additional channel.

The openings can be arranged substantially in a plane that is perpendicular to the axis of the inlet channel, whereby the at least one opening may have a circular, oval, rectangular, or any other cross section.

In another embodiment, the openings can be arranged along the entire length of the additional channel. For example, in this embodiment the number of openings corresponds to the number of flat tubes, so that for each flat tube an opening is provided in the additional channel, said opening being located preferably in the immediate vicinity of the respective flat tube.

In another embodiment of the invention, the additional channel can be arranged concentrically or eccentrically in the inlet channel, so that an annular gap in which the refrigerant is distributed to the flow device forms between the two channels.

In another embodiment of the invention, two or more channels are arranged within the inlet channel. The refrigerant in this case first flows into the first additional channel, then into the additional channels, and finally into the inlet channel, from where the refrigerant is distributed to the flow device.

In an embodiment of the invention, a longitudinal gap is formed between the inlet channel and the additional channel. The advantage of this embodiment is the simple insertion of the additional channel into the inlet channel, whereby both channels are preferably formed as tubes.

In another embodiment of the invention, the at least one additional channel can be arranged partially or completely outside the inlet channel and is connected to said channel in a communicating manner via at least one opening, which is arranged preferably in the middle of the additional channel.

In another embodiment, the inlet channel can be formed by two half-shells, which are connected form-fittingly and/or by material bonding with one another. In this embodiment, the additional channel is arranged within the inlet channel. Preferably, in this case, a half-shell has crenellation-like projections, which engage in the corresponding recesses of the other half-shell. Because of an embodiment of this type, both half-shells are connected to one another especially pressure-tight and in a stable manner.

In another embodiment, the inlet channel can be formed by a trough-shaped half-shell on which the additional channel lies form-fittingly and/or by material bonding.

In another embodiment of the invention, two or more additional channels can be arranged outside the inlet channel and are connected in series with one another in a communicating manner. The refrigerant therefore first flows into the first additional channel, then into the additional channels, and finally into the inlet channel, from where the refrigerant is distributed to the flow device. The two or more additional channels can be made, for example, as tubes or as plates, which form hollow spaces stacked one above the other in which the refrigerant is distributed to the inlet channel and the flow device.

In another embodiment of the invention, the inlet channel, the at least one additional channel, which may be arranged within and/or outside the inlet channel, and/or the outlet channel can be arranged on a side of the heat exchanger and connected to one another form-fittingly and/or by material bonding. An embodiment of this type is especially suitable for evaporators with shallow depths. The channels are formed tubular or box-shaped and have a circular or semicircular, triangular, or rectangular cross section or a combination of said cross sections or any other cross section.

In another embodiment, the channels can be formed from shaped metal sheets, which are connected form-fittingly and/or by material bonding with one another. Any cross sections for the channels can be produced by this embodiment. For example, the cross section of the channels can be essentially semicircular and/or circular.

In another embodiment of the invention, at least one additional channel is connected to the outlet channel via at least one opening in a communicating manner. The additional channel is located within and/or outside the outlet channel and is formed according to the previously described embodiments. In this embodiment, the additional channel is used to collect the refrigerant.

It is understood that the aforementioned features and the features still to be explained hereafter can be used not only in the specifically indicated combination but also in other combinations or alone, without going beyond the scope of the present invention.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1A:
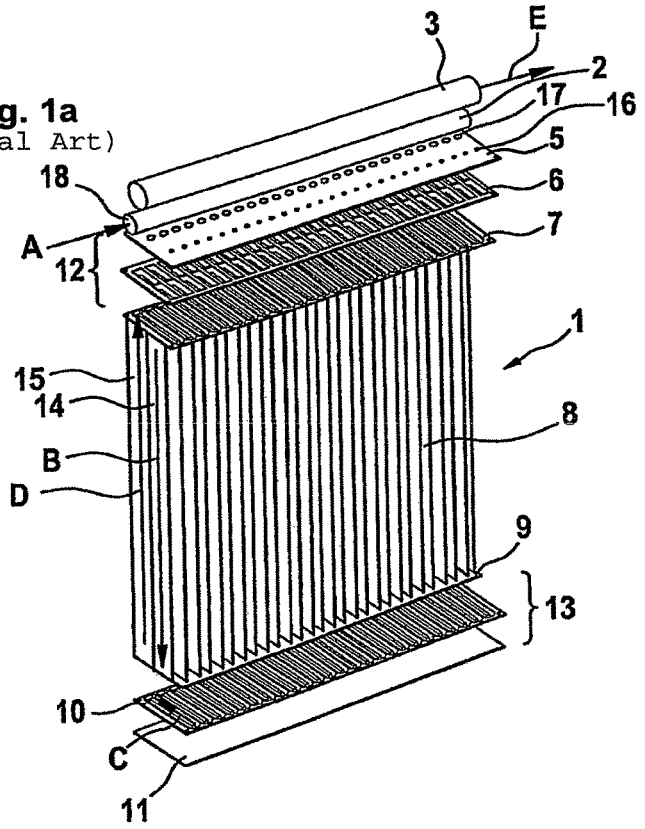
Fig. 1a (Conventional Art)
FIG. 1*a* shows an exploded illustration of a heat exchanger to illustrate the conventional art.

Consistent reference characters are used in the drawings for the same or similar components.

Figure 1B:
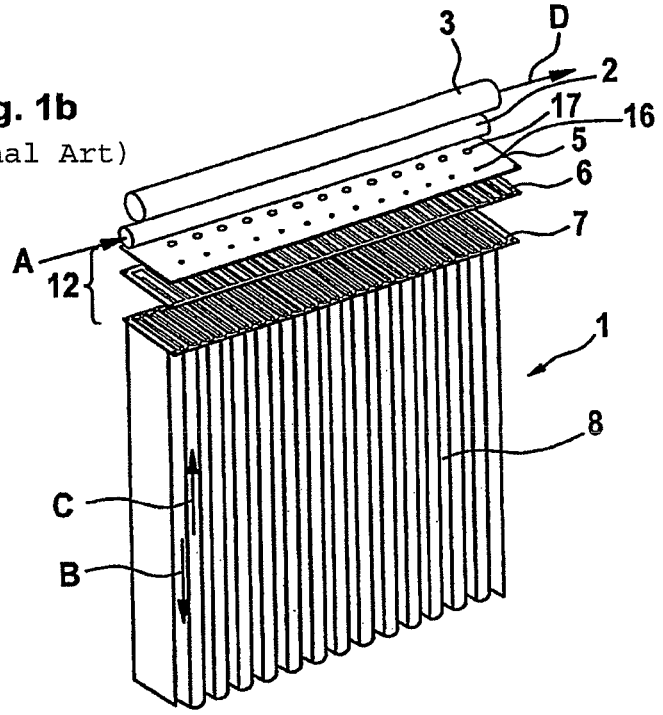
Fig. 1b (Conventional Art)
FIG. 1*b* shows an exploded illustration of a heat exchanger to illustrate the conventional art.
Figure 2:
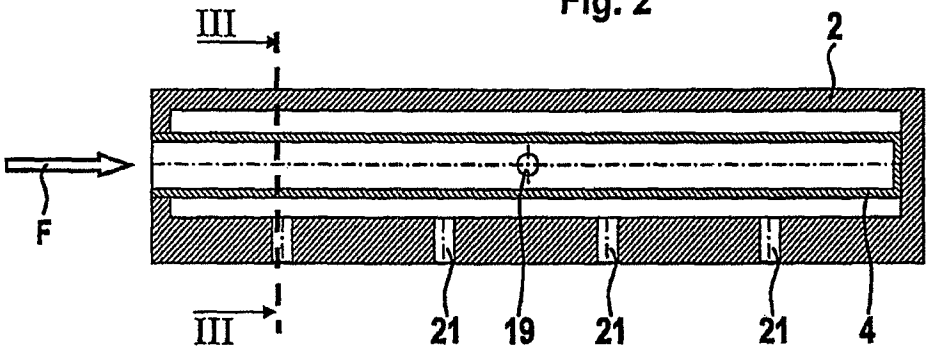
FIG. 2 shows a first exemplary embodiment of an inlet channel of a heat exchanger of the invention in a side view.
Figure 3:
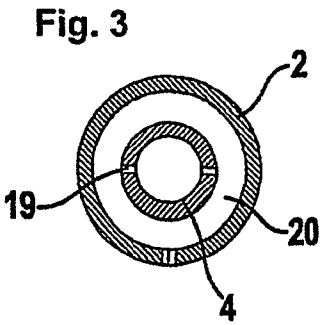
FIG. 3 shows an inlet channel of a heat exchanger of the invention in a front view along the line III-III in FIG. 2.
Figure 4:
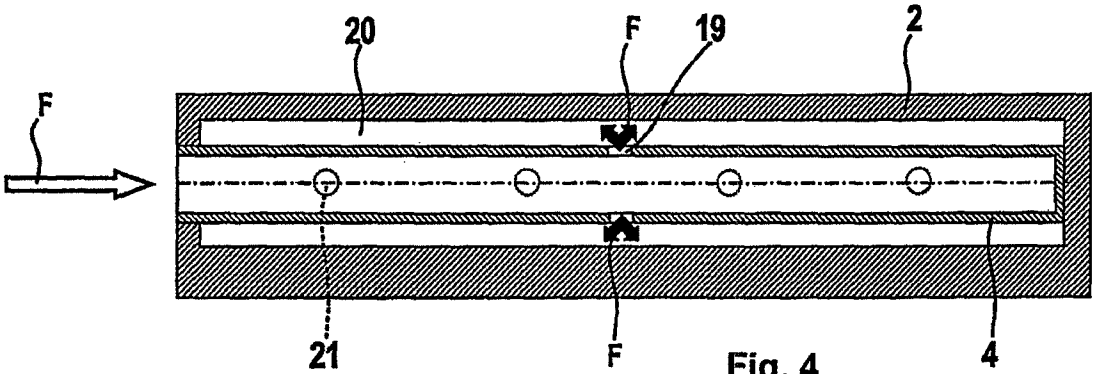
FIG. 4 shows an inlet channel in a plan view according to the first exemplary embodiment.

FIGS. 2 to 4 show a first exemplary embodiment of an inlet channel 3 of a heat exchanger in different views according to the present invention. A heat exchanger of this type differs from the conventional art according to FIG. 1, particularly in the design of inlet channel 3.

According to FIGS. 2 to 4, inlet channel 3 is connected in a communicating manner to an additional channel 4 via two openings 19, which are arranged substantially in the middle of the inlet channel. The refrigerant therefore flows as shown by the arrow F via additional channel 4 into heat exchanger 1 and is distributed via the two openings 19 (indicated by arrow F) in an annular gap 20, which forms between inlet channel 3 and additional channel 4. From this annular gap, the refrigerant flows through openings 21 into the tubes that form flow device 8.

The two openings 19, which connect the additional channel with the inlet channel in a communicating manner, are arranged substantially on opposite sides of the additional channel and aligned in a direction that is perpendicular to the evaporator network plane.

In an exemplary embodiment that is not shown, the two openings 19 are rotated 90° clockwise in comparison with the exemplary embodiment shown in FIG. 2 to FIG. 4. Naturally, it is also possible to position the at least one opening at any other locations in the additional channel.

The inlet channel and the additional channel are formed as a tube, whereby it is possible to insert the additional channel into the inlet channel.

The ratio between the inside diameter of the additional channel and the diameter of opening 19, which is made preferably as a bored hole, is between 1.25 and 5, preferably between 1.25 and 2.5. The ratio between the inside diameter of the additional channel and the hydraulic diameter of the annular gap is between 1 and 20, preferably between 1 and 6. These geometric ratios assure that the individual cross-sectional areas have the same relationship to the specific mass flow of the refrigerant and no pressure spikes arise during the flow of the refrigerant through the openings or through the annular gap.

Collector 12 in this case can include three plates, namely, an injection plate, a distribution plate, and a bottom plate, as they are illustrated in FIG. 1 and FIG. 2. According to another embodiment of the invention, the collector can be made up of two metal sheets 50 and 70, which are produced particularly by a shaping method, preferably by a deep-drawing method.

Figure 5:
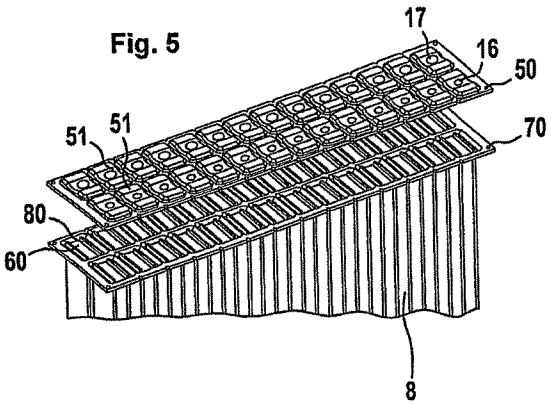
FIG. 5 shows a collector with two metal sheets in a perspective exploded illustration for an evaporator with deflection depth-wise.
Figure 6:
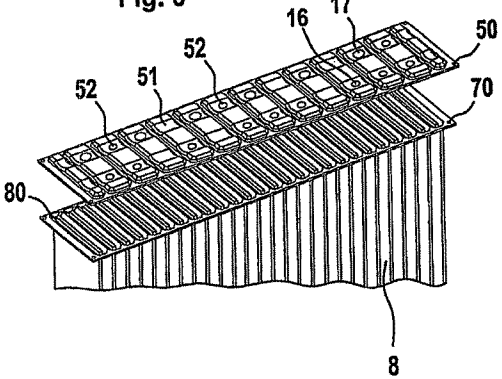
FIG. 6 shows a collector with two metal sheets in a perspective exploded illustration for an evaporator with deflection width-wise.

FIGS. 5 and 6 show a collector of this type for an evaporator with deflection depth-wise (FIG. 5) or width-wise (FIG. 6). A collector of this type can have two metal sheets, an upper 50 and a lower metal sheet 70, which are connected to one another form-fittingly and/or by material bonding. The inlet channel and/or the outlet channel and/or the at least one additional channel are placed in a trough-shaped depression 51 in the upper metal sheet 50, whereby the secured positioning of the individual channels is assured by positioning nubs 52 or individual bored passages.

The upper metal sheet 50 and the lower metal sheet 70 each have chamber-like convex areas 60 in the opposite direction. The chambers form the hollow spaces for distributing the refrigerant from injection holes 16 to flow device 8. The middle distribution plate can be omitted because of this design. According to FIG. 5 and FIG. 6, this flow device includes multichannel flat tubes 80.

Each chamber accommodates one or more flat tubes, preferably two flat tubes (see FIG. 5), in which the refrigerant is distributed further. The heat exchanger is made either as a single row or two rows. This means that either one flat tube (see FIG. 6) or two flat tubes (see FIG. 5) are arranged depth-wise. The accommodation of the flat tubes in the collector occurs, for example, through a split passage on the collector side toward the exterior or interior or through a punch.

Figures 7, 8A, 8B:
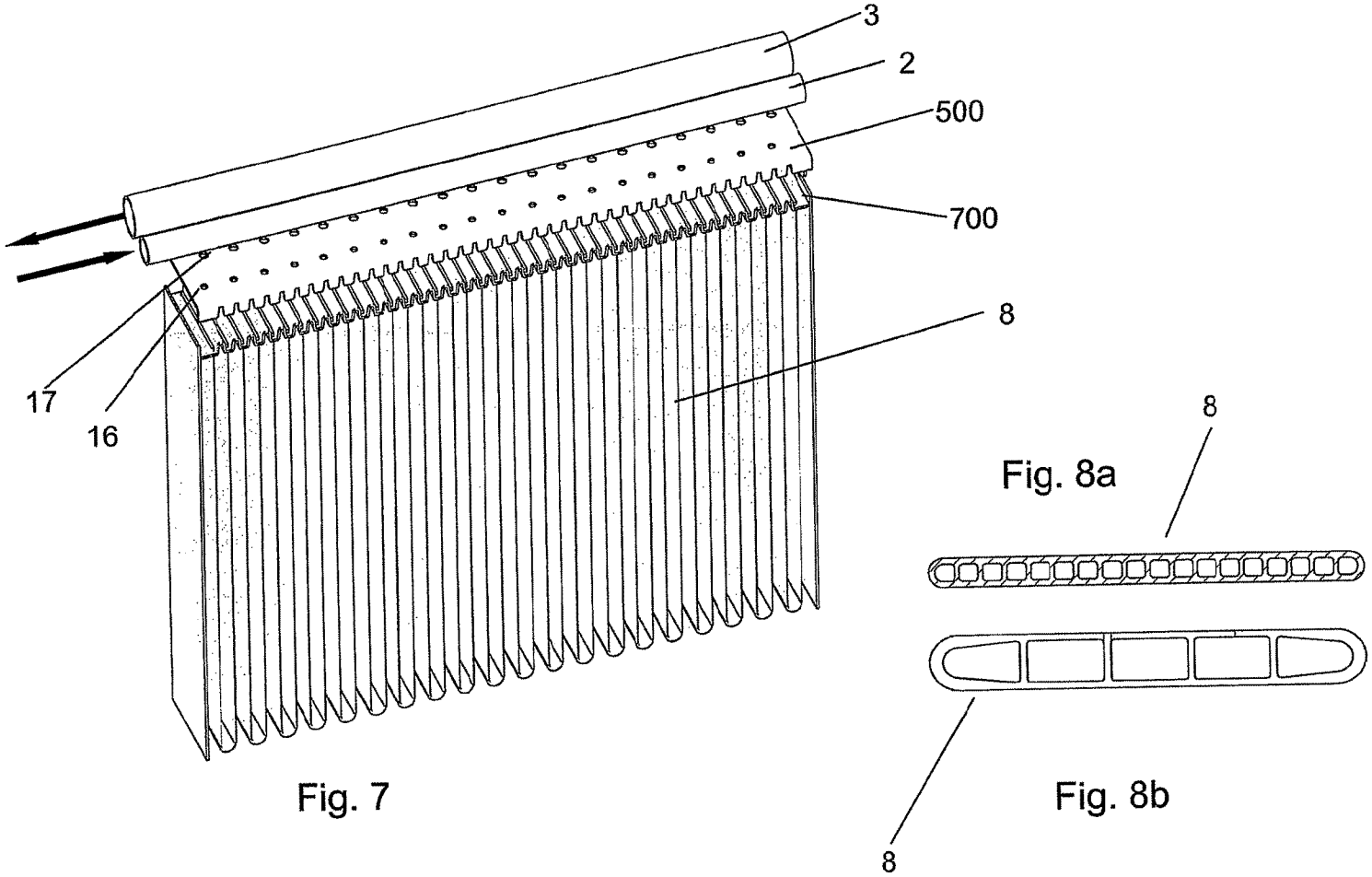
FIG. 7 shows another exemplary embodiment of a collector of the invention for an evaporator with deflection width-wise.
FIG. 8*a* shows multichannel flat tubes for an evaporator with deflection width-wise or deflection depth-wise.
FIG. 8*b* shows multichannel flat tubes for an evaporator with a multiblock connection.

FIG. 7 shows another exemplary embodiment of a collector of the invention for an evaporator with deflection width-wise. In this case, bottom plate 700 is designed as a corrugated profile, whereby the flat tubes are accommodated in the corrugation troughs. A closed collector is formed by a simple U-shaped closing metal sheet 500; no additional closing covers are necessary for this.

The hollow spaces for distributing the refrigerant from injection hole(s) 16 to the individual flat tubes 8, as well as the chamber partitions between the individual flat tubes are created by the corrugated profile. Alternatively, bottom plate 700 can also be formed as a flat plate and closing metal sheet 500 as a corrugated profile.

For an evaporator with deflection depth-wise, a continuous elevation or a wall transverse to the corrugation troughs is introduced into the corrugated profile to create a partition plane in the depth-wise direction.

Preferably, in an evaporator with deflection width-wise or with deflection depth-wise (so-called "dual-flow" evaporator), multichannel flat tubes 8 with smaller chambers (FIG. 8*a*) or cross-sectional areas are used in comparison with the multichannel flat tubes in a multiblock connection (FIG. 8*b*), because here the refrigerant mass flow is distributed simultaneously to all tubes, whereas in a multiblock connection the entire mass flow is distributed parallel only to one part of the tubes, for example, to approximately a third of the tubes in a 6-block or half in a 4-block connection. As a result, the flat tubes can be made more filligreed, and weight and cost can therefore also be saved.

Figure 9:
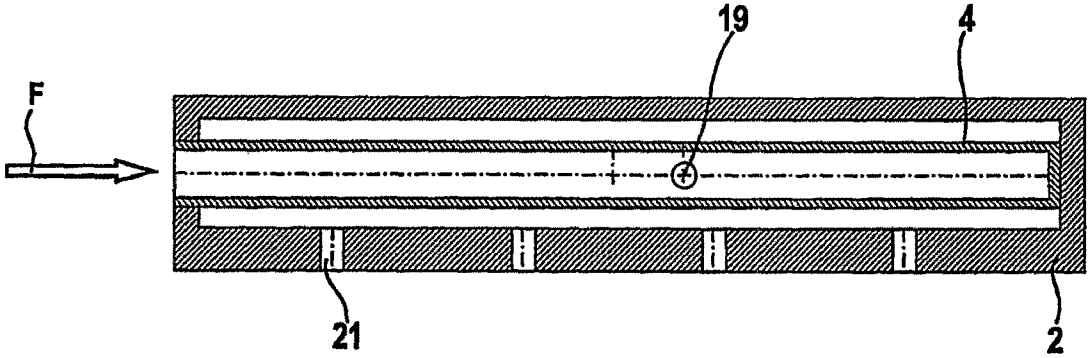
FIG. 9 shows an inlet channel in a side view according to the second exemplary embodiment.
Figure 10:
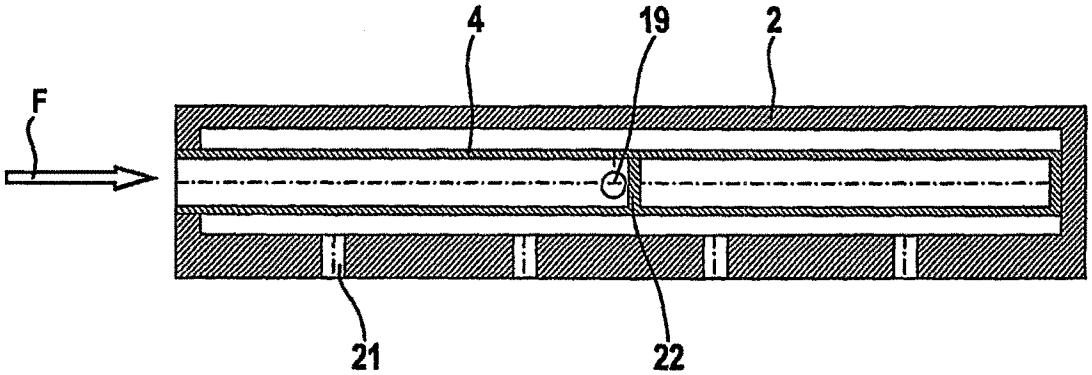
FIG. 10 shows an inlet channel in a side view according to the third exemplary embodiment.
Figure 12:
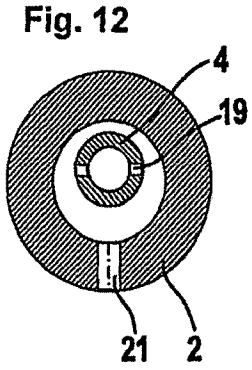
FIG. 12 shows an inlet channel of a heat exchanger of the invention in a front view along the line X-X in FIG. 11.
Figure 11:
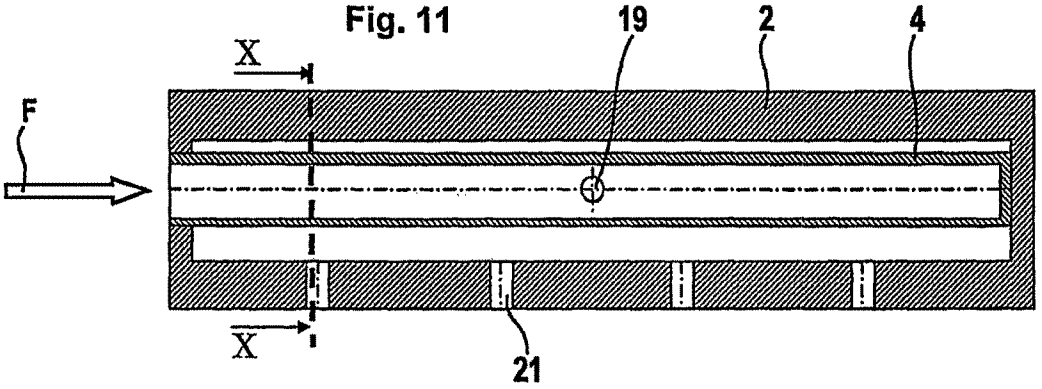
FIG. 11 shows an inlet channel in a side view according to the fourth exemplary embodiment.
Figure 13E:
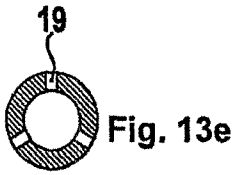
FIG. 13*a* to FIG. 13*e* show different embodiments for the positioning of the openings, which connect the inlet channel with the additional channel in a communicating manner.
Figure 13D:
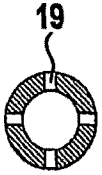
Figure 13C:
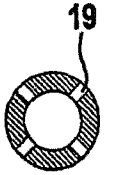
Figure 13B:
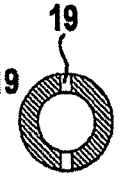
Figure 13A:
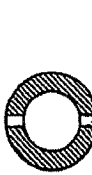
Figure 14F:
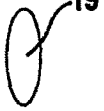
FIG. 14*a* to FIG. 14*f* show different embodiments for the openings according to FIG. 13*a* to FIG. 13*e;*
Figure 14E:
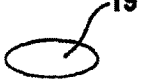
Figure 14D:
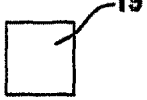
Figure 14C:
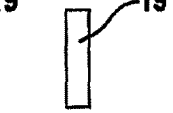
Figure 14B:
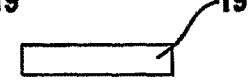
Figure 14A:
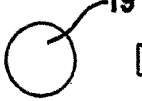

In FIGS. 9 to 11, three additional exemplary embodiments of an inlet channel according to the present invention are shown in a side view. FIG. 12 shows a front view of the fourth exemplary embodiment according to FIG. 11. In FIG. 9, the two openings 19 are arranged at a distance from the middle of the inlet channel. In FIG. 10, the additional channel 4 is closed by a partition wall 22 beyond openings 19 when viewed in the direction of flow, to counteract a negative effect of the backing up of the refrigerant. The additional channel is positioned concentrically or eccentrically in the inlet channel (see FIG. 11 and FIG. 12).

Different embodiments of the position, shape, and number of openings 19 are illustrated in FIG. 13*a* to FIG. 13*e* or FIG. 14*a* to FIG. 14*f*. Accordingly, the additional channel is connected to the inlet channel via two or more openings, which are arranged substantially in a plane perpendicular to the axis of the inlet channel. With an even number of openings, two openings each are arranged preferably diametrically.

In an exemplary embodiment that is not shown, the additional channel is connected to the inlet channel in a communicating manner via an opening.

Figures 15, 16, 17, 18, 19, 20:
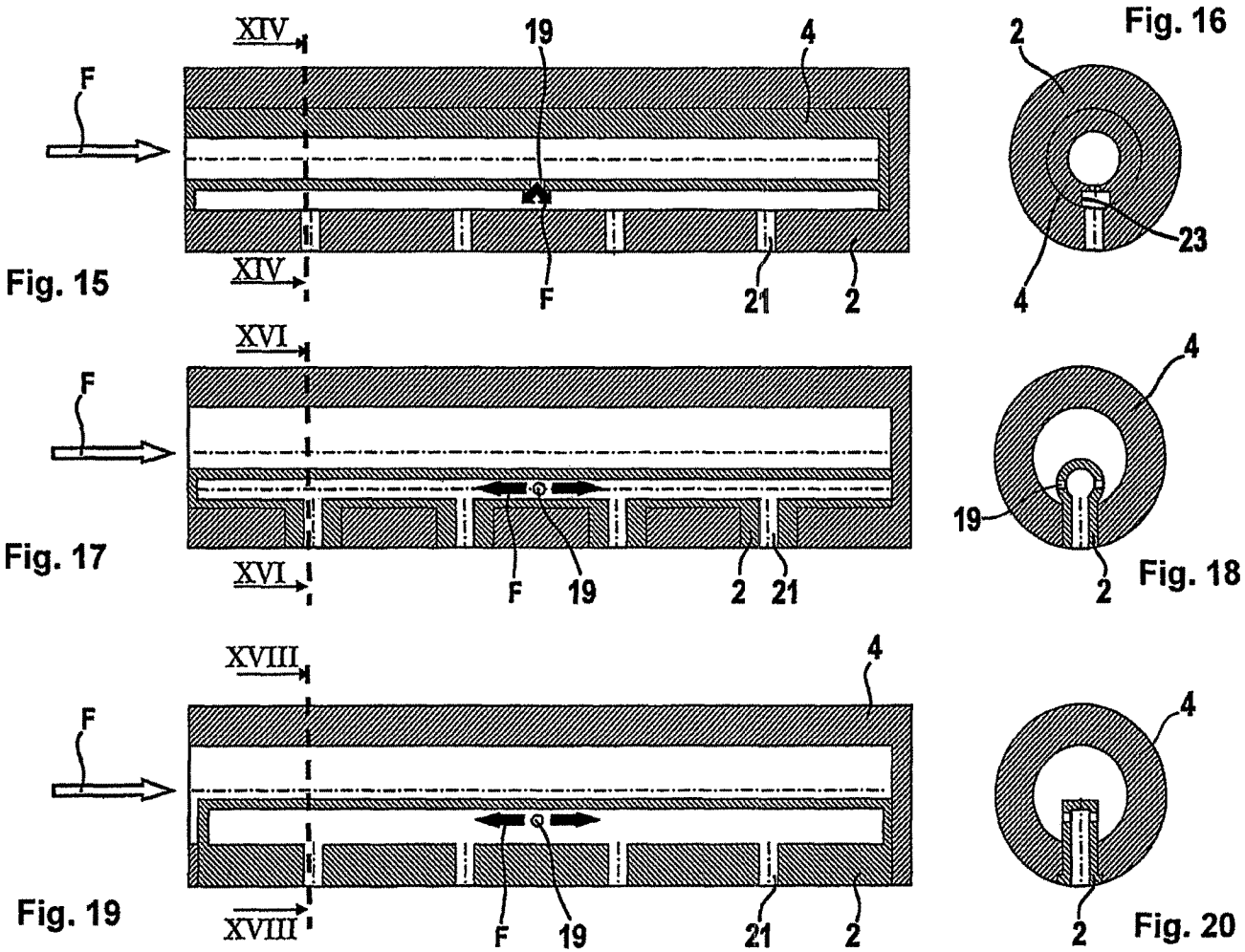
FIG. 15 shows an inlet channel in a side view according to the fifth exemplary embodiment.
FIG. 16 shows an inlet channel of a heat exchanger of the invention in a front view along the line XIV-XIV in FIG. 15.
FIG. 17 shows an inlet channel in a side view according to the sixth exemplary embodiment.
FIG. 18 shows an inlet channel of a heat exchanger of the invention in a front view along the line XVI-XVI in FIG. 17.
FIG. 19 shows an inlet channel in a side view according to the seventh exemplary embodiment.
FIG. 20 shows an inlet channel of a heat exchanger of the invention in a front view along the line XVIII-XVIII in FIG. 19.

In FIGS. 15 and 16, the fifth exemplary embodiment is illustrated in a side and front view. The additional channel 4 is inserted into inlet channel 2 and has a recess 23, so that a longitudinal gap 24 results in which the refrigerant is distributed to the tubes through openings 21. The course of the at least one opening 19 is formed substantially perpendicular or oblique to the inlet channel.

In an exemplary embodiment that is not shown, the additional channel 4 has a D-shaped cross section, with the result of a different shape of the cross section of longitudinal gap 24.

FIGS. 17 to 20 show the sixth and seventh exemplary embodiment in a side and front view. In both exemplary embodiments, additional channel 4 is arranged outside of inlet channel 2, whereby the inlet channel is pushed into the additional channel. This insertion occurs either from inside (FIG. 17) or from outside in that the inlet channel is pushed into a recess 25 of the additional channel (FIG. 19).

Figure 21:
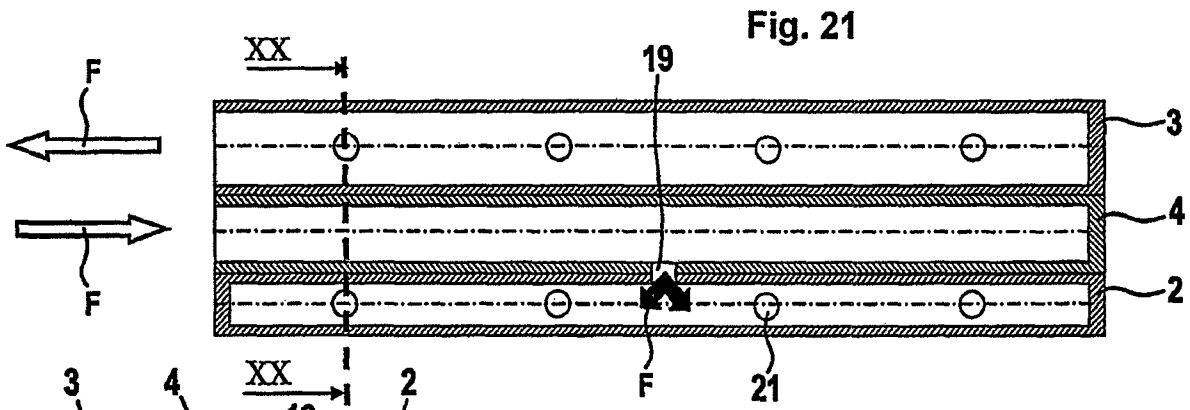
FIG. 21 shows a plan view of the inlet channel, outlet channel, and an additional channel according to the eighth exemplary embodiment according to the present invention.
Figure 22:
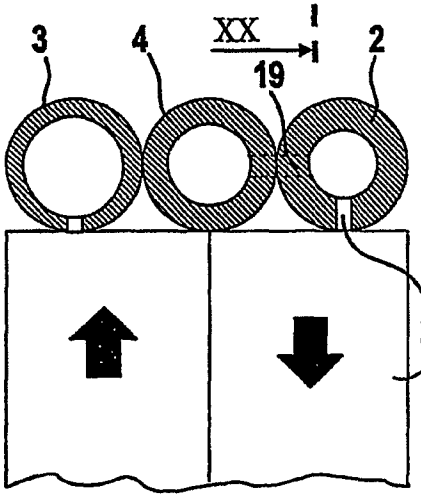
FIG. 22 shows a front view of the inlet channel, outlet channel, and an additional channel along the line XX-XX in FIG. 21.

In FIGS. 21 and 22, the eighth exemplary embodiment is illustrated schematically in a plan and front view. The inlet channel, the outlet channel, and the additional channel are formed as round tubes and connected to one another by material bonding, whereby the additional channel is arranged outside the inlet channel.

Figure 23:
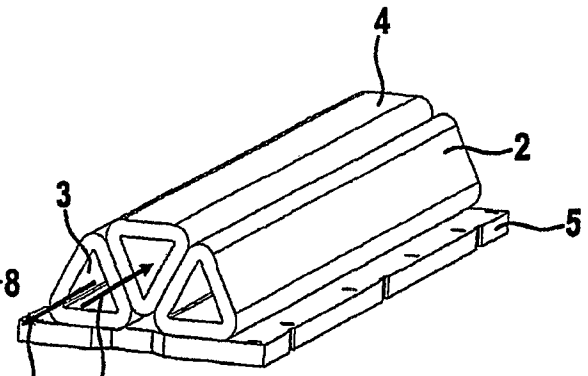
FIG. 23 shows a perspective view of the inlet channel, outlet channel, and an additional channel according to the ninth exemplary embodiment according to the present invention.

FIG. 23 shows the ninth exemplary embodiment and a refinement of the heat exchanger according to FIGS. 21 and 22. The inlet channel, the outlet channel, and the additional channel are formed as tubes with a triangular shape. Due to this embodiment, sufficient soldering surface area is available between the triangular tubes themselves and between the triangular tubes and injection plate 5 in order to connect the tubes by material bonding with one another and with the injection plate. The at least one opening, which connects the additional channel to the inlet channel in a communicating manner, is preferably arranged in the middle or at any other sites of the additional channel and of the inlet channel. In comparison with the eighth exemplary embodiment, this embodiment results in space optimization, which is particularly suitable for evaporators with small depths, whereby the extension of the evaporator lengthwise is understood as the depth and the extension of the evaporator transverse to the main flow direction of the air as the width.

Figure 24:
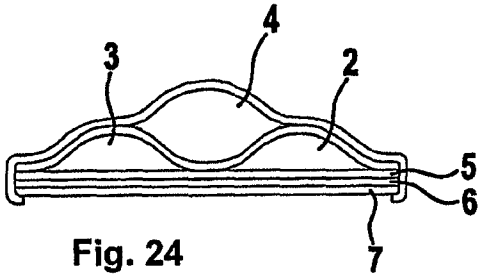
FIG. 24 shows a front view of the inlet channel, outlet channel, and an additional channel according to the tenth exemplary embodiment according to the present invention.

The tenth exemplary embodiment is shown in a front view in FIG. 24. In this embodiment, the inlet channel, the outlet channel, and the additional channel are formed by shaped metal sheets, which are connected to one another form-fittingly and/or by material bonding. According to FIG. 22, cross sections of the inlet and outlet channel are substantially semicircular and the cross section of the additional channel is substantially circular. Of course, in an embodiment that is not shown, any other shape of the cross section is possible. An especially advantageous manufacturing process for the different channels is possible by means of this embodiment.

Figure 25:
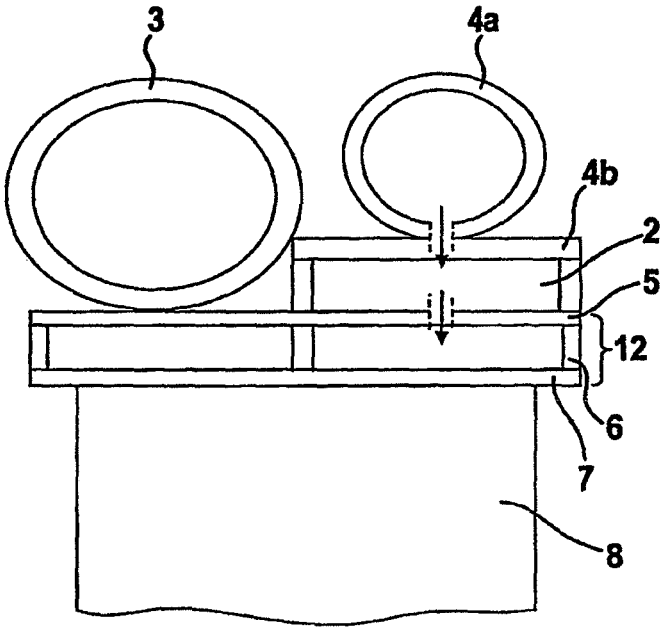
FIG. 25 shows a detail of the front view of a heat exchanger according to the eleventh exemplary embodiment according to the present invention.
Figure 27:
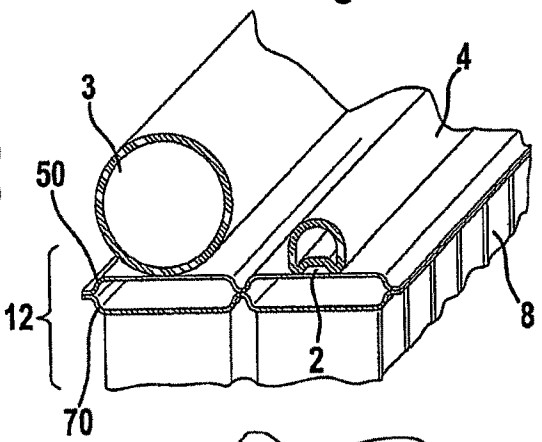
FIG. 26 to FIG. 29 show a perspective view of the inlet channel, outlet channel, and an additional channel according to the twelfth, thirteenth, fourteenth, and fifteenth exemplary embodiments according to the present invention.
Figure 26:
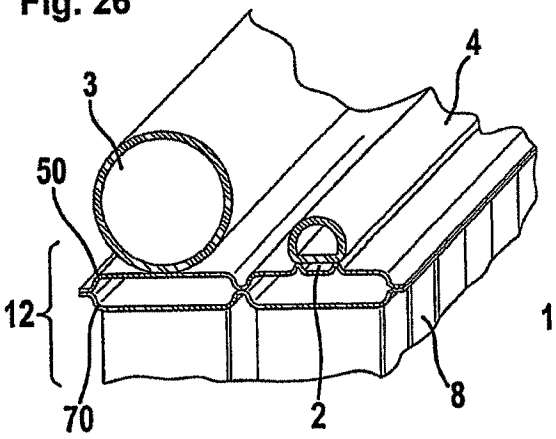
Figure 29:
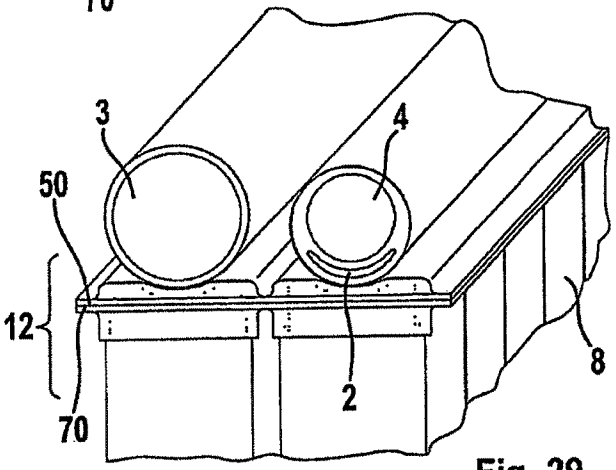
Figure 28:
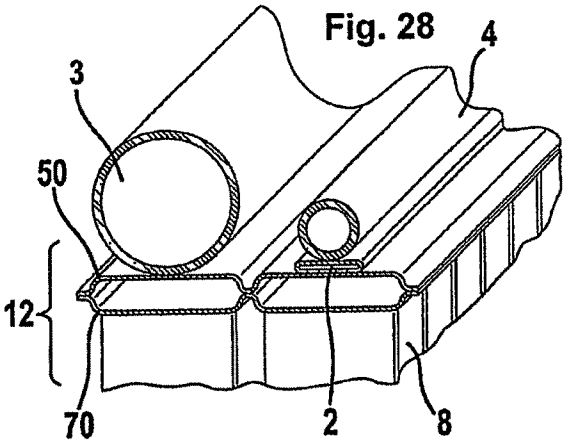

The eleventh exemplary embodiment of a detail of a heat exchanger of the invention is shown in a front view in FIG. 25. In this embodiment, collector 12 has three plates. The first additional channel 4*a*, which is formed as a tube, lies on the plate-shaped second additional channel 4*b* and is connected with said channel in a communicating manner. The refrigerant flows from the first additional channel 4*a* into the second additional channel 4*b* and into the inlet channel 2. From there, the refrigerant is distributed to collector 12 and flow device 8.

In FIGS. 26 to 29, four additional exemplary embodiments according to the present invention are shown. In the embodiment according to FIG. 26, the additional channel 4 is positioned in such a way on the top metal sheet 50 of collector 12 that an inlet channel 2 forms together with the specially shaped top metal sheet 50. In the embodiment according to FIG. 27, the additional channel 4 is shaped and positioned on the top metal sheet 50 of collector 12 in such a way that an inlet channel 2 forms together with the top metal sheet. In the embodiment according to FIG. 28, the inlet channel is formed by a flat tube, which is arranged between the additional channel and the collector. In the embodiment according to FIG. 29, the additional channel 4 and the inlet channel 2 are formed by a tube, which is produced particularly by an extrusion process.

Figure 31:
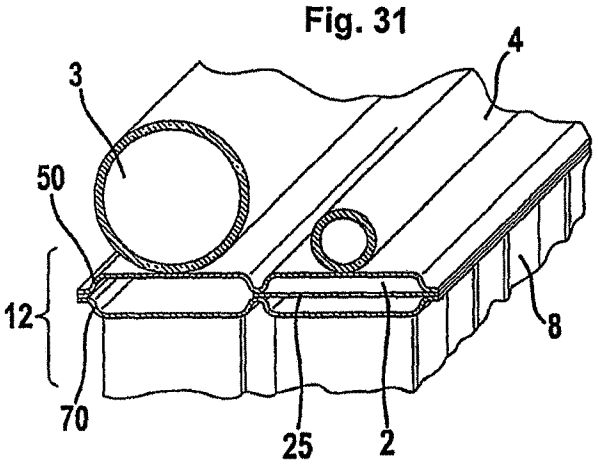
FIG. 30 to FIG. 32 show a perspective view of the inlet channel, outlet channel, and an additional channel according to the sixteenth, seventeenth, and eighteenth exemplary embodiments according to the present invention.
Figure 30:
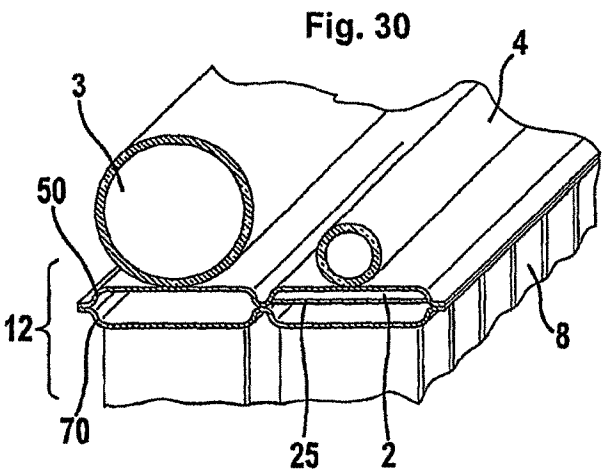
Figure 32:
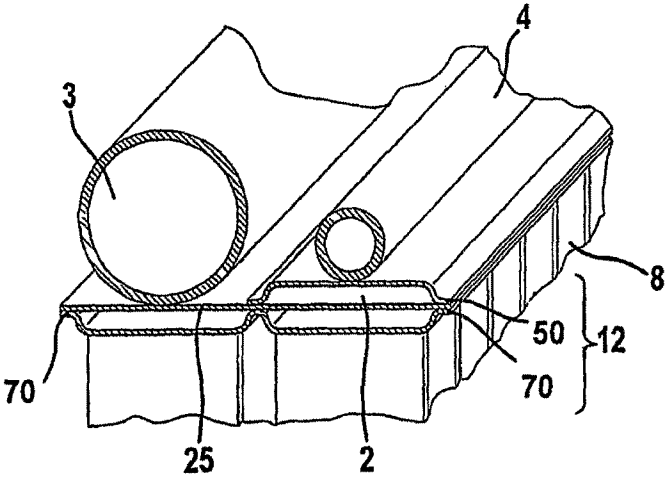

FIG. 30 to FIG. 32 show three additional exemplary embodiments of a heat exchanger according to the present invention. In these embodiments, inlet channel 2 is created by a metal sheet 25 in collector 12. According to FIG. 31, the inlet channel is created by a continuous metal sheet 25, which is stamped out on the intake side. In the exemplary embodiment according to FIG. 32, the inlet channel is created by a continuous metal sheet, whereby outlet channel 4 lies on this metal sheet and is connected to it form-fittingly and/or by material bonding.

Figure 33B:
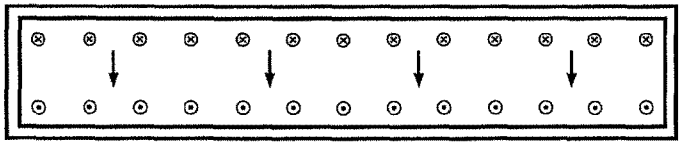
FIG. 33*a* and FIG. 33*b* show a perspective view and a detailed view along the line X-X in FIG. 33*a* of the inlet channel, outlet channel, and an additional channel according to the nineteenth exemplary embodiment according to the present invention.
Figure 33C:
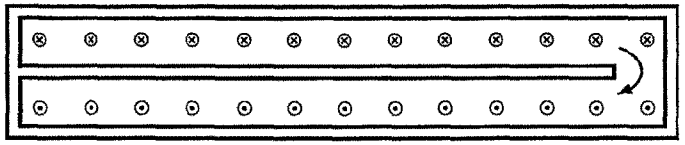
Figure 33D:
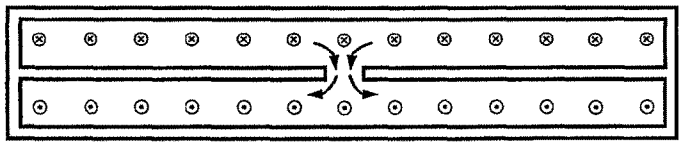
Figure 33A:
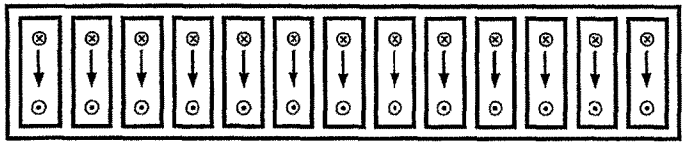

FIG. 33*a* and FIG. 33*b* show an embodiment in a perspective illustration and in a detail illustration along the line X-X in FIG. 33*a*, in which inlet channel 2 is formed by a trough-shaped half-shell. The trough-shaped shell has a stamped-in area 27 (FIG. 33*b*), on which additional channel 4 lies form-fittingly and/or by material bonding. The additional channel has a round shape, but alternatively other shapes are also conceivable. For example, a larger volume of inlet channel 2 can be achieved by an oval shape of additional channel 4. In another embodiment that is not shown, the trough-shaped shell can also be made flat.

Figure 34:
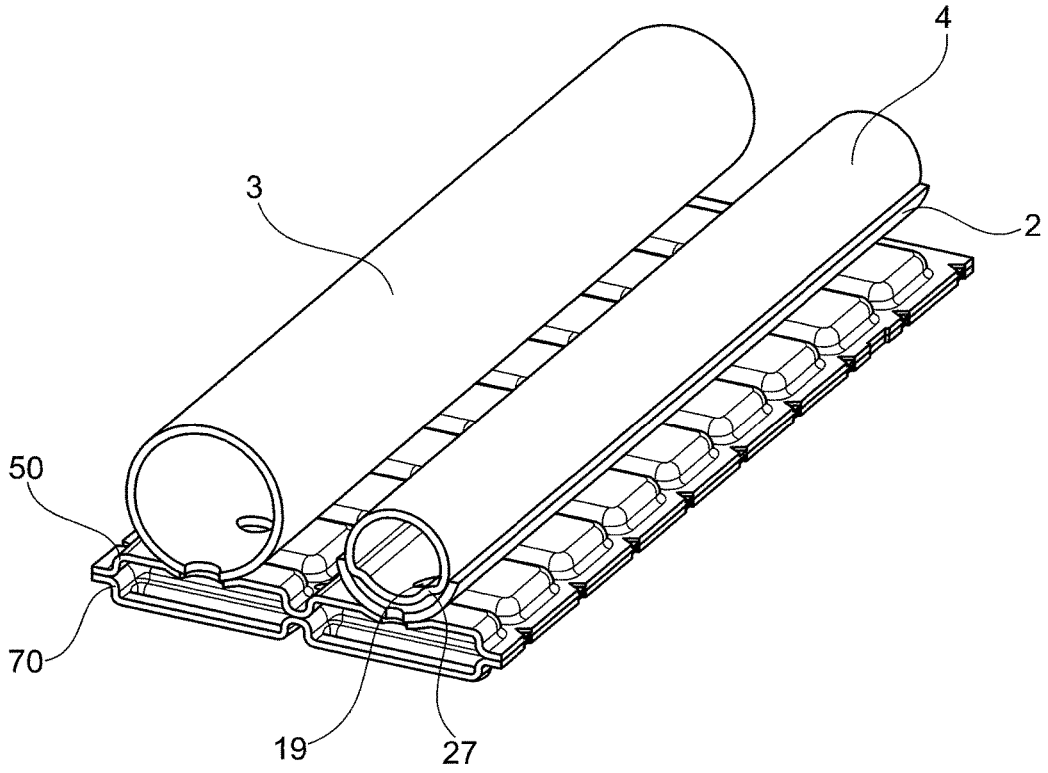
FIG. 34 shows a detail view of the inlet channel, outlet channel, and an additional channel according to the twentieth exemplary embodiment according to the present invention.

FIG. 34 shows an embodiment similar to that in FIG. 33*a* and FIG. 33*b*. In this exemplary embodiment, the inlet channel is formed by a stamped-in area 27 in additional channel 4.

Figure 35A:
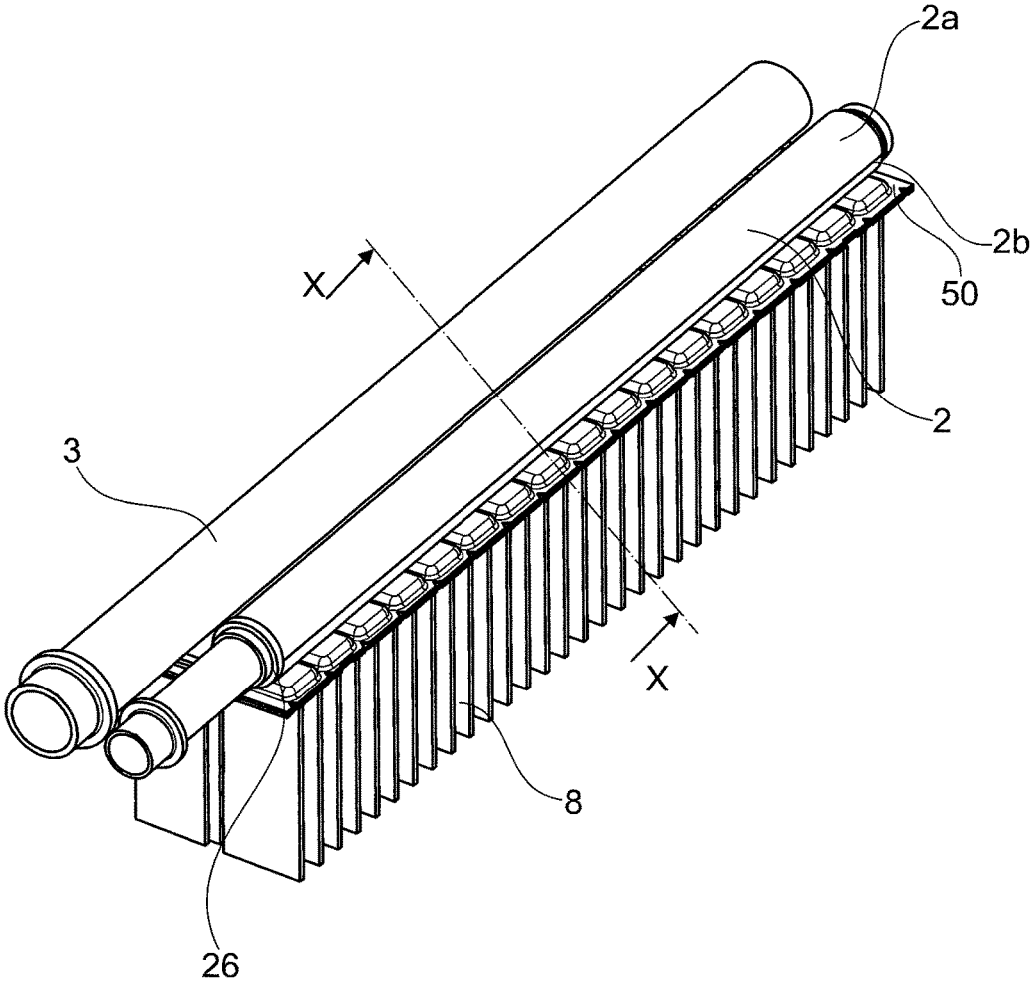
FIG. 35*a* and FIG. 35*b* show a perspective view and a detail view of the inlet channel, outlet channel, and an additional channel according to the twenty-first exemplary embodiment according to the present invention.
Figure 35B:
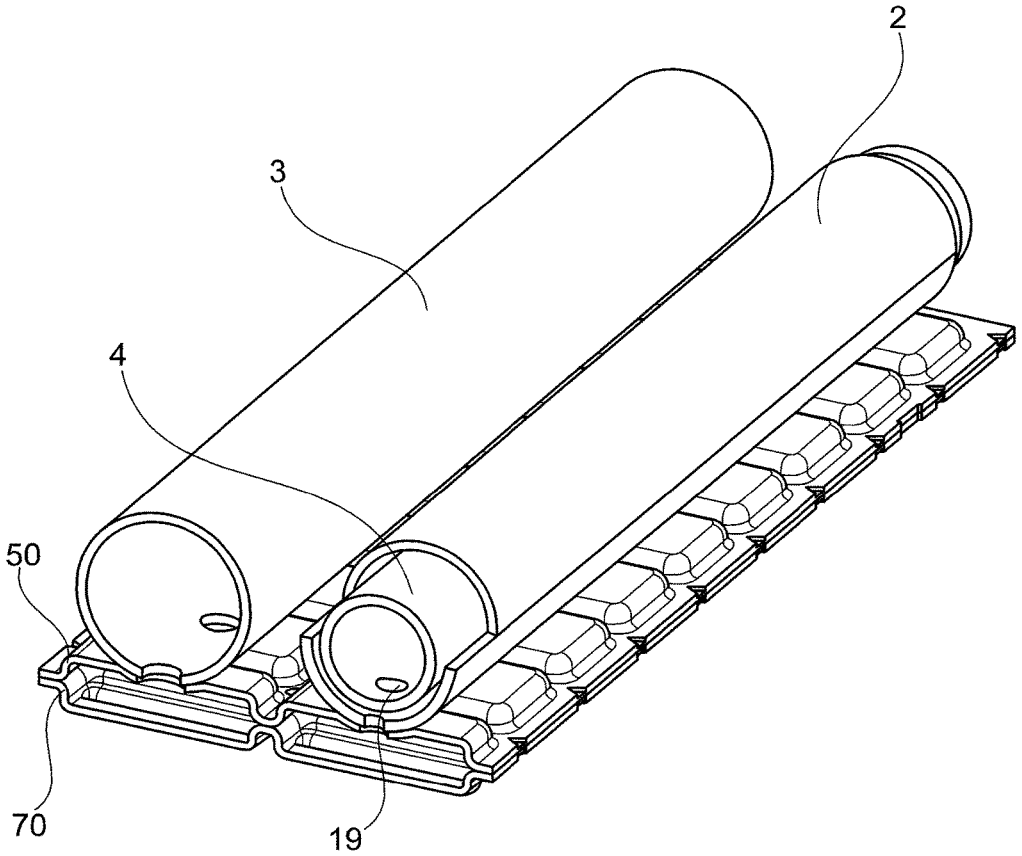
Figure 36:
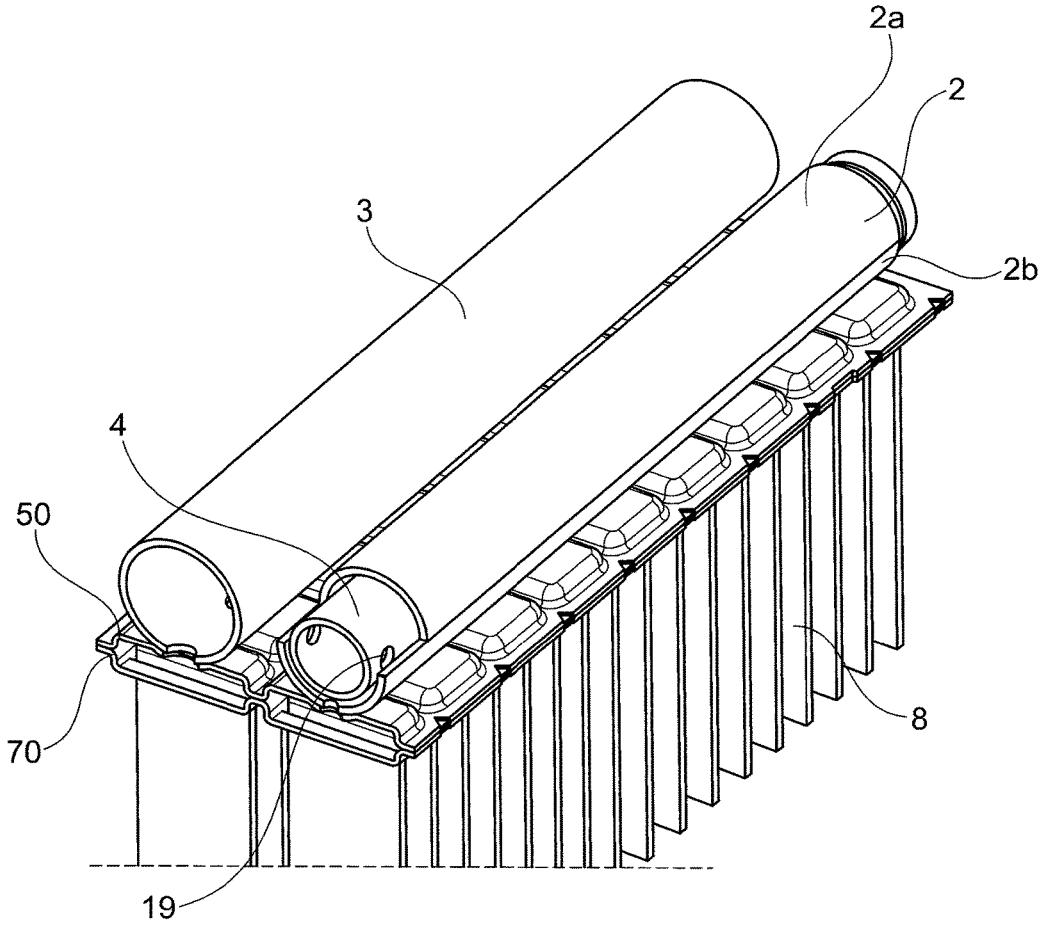
FIG. 36 shows a detail view of the inlet channel, outlet channel, and an additional channel according to the twenty-second exemplary embodiment according to the present invention.

In the exemplary embodiment according to FIG. 35*a* and FIG. 35*b*, whereby FIG. 35*b* shows a detail view along the line X-X in FIG. 35*a*, inlet channel 2 is formed by a top 2*a* and bottom 2*b* half-shell, whereby additional channel 4 is arranged within inlet channel 2. Opening 19, which connects inlet channel 2 to additional channel 4 in a communicating manner, is arranged in such a way that a vertical flow arises between the inlet channel and the additional channel. According to FIG. 36, two openings 19 are arranged in such a way that a horizontal flow of the first medium forms between the inlet channel and the additional channel.

A sufficient tightness is assured by a form-fitting connection 26 (see FIG. 35*a*) at both ends of inlet channel 2 to additional channel 4, so that no additional closing covers are necessary. A similar positive fit for sealing is also conceivable in the exemplary embodiments according to FIG. 33 and FIG. 34.

Figure 41:
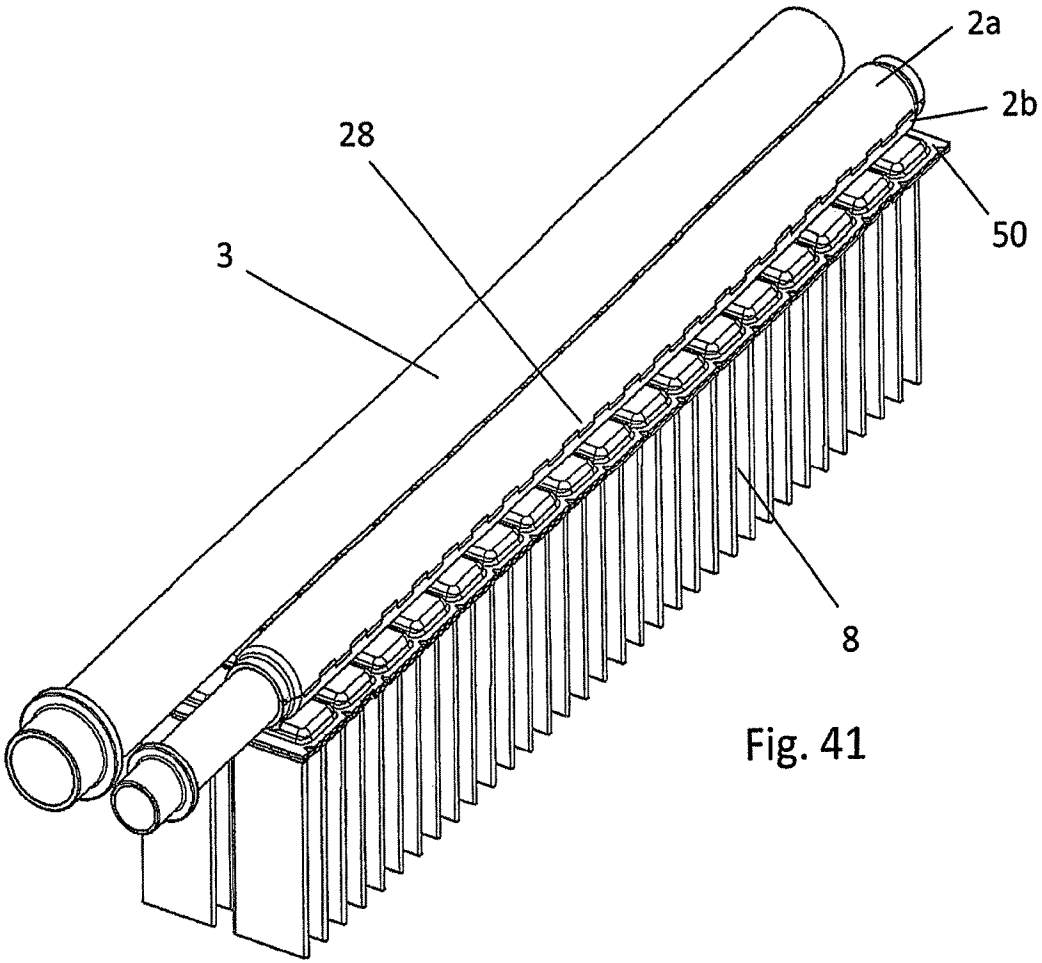
FIG. 41 shows a perspective view of a heat exchanger.

The two half-shells 2*a* and 2*b* are connected to one another particularly form-fittingly and/or by material bonding, for example, clipped to one another. Alternatively, a half-shell has crenellation-like projections 28, which engage in the corresponding recesses of the other half-shell (FIG. 41).

Figure 37A:
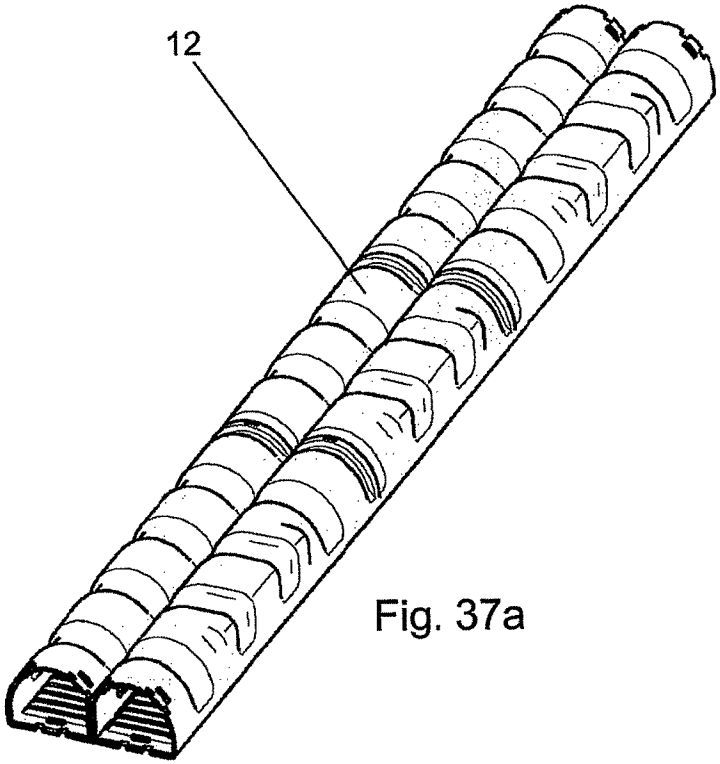
FIG. 37*a* and FIG. 37*b* show a prospective illustration of a collector and a front view of the collector with an additional channel according to the twenty-third exemplary embodiment according to the present invention.
Figure 37B:
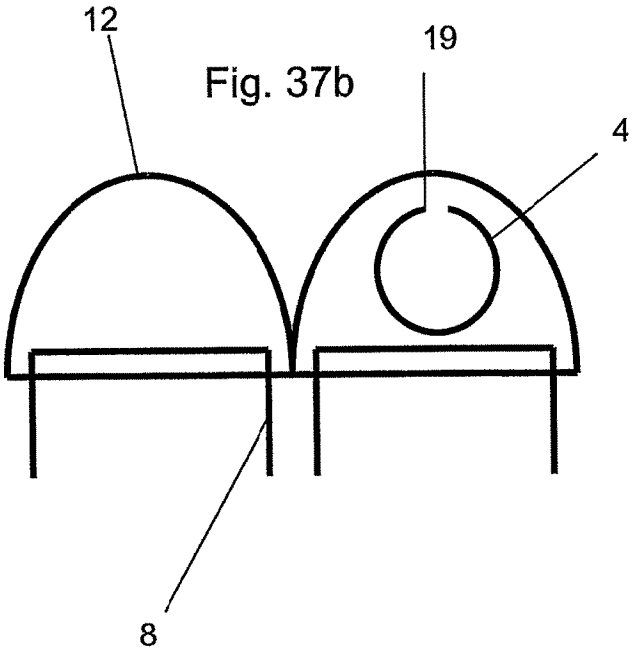

FIG. 37*a* shows a collector 12, whereby additional channel 4 is arranged within collector 12. Opening 19, which connects additional channel 4 to collector 12 in a communicating manner, according to FIG. 37*b* is arranged in a top region of the additional channel. Alternatively, one or more openings can also be arranged at a different site, for example, such that similar to the exemplary embodiment according to FIG. 36, a horizontal flow of the first medium arises between additional channel 4 and collector 12.

Figure 38:
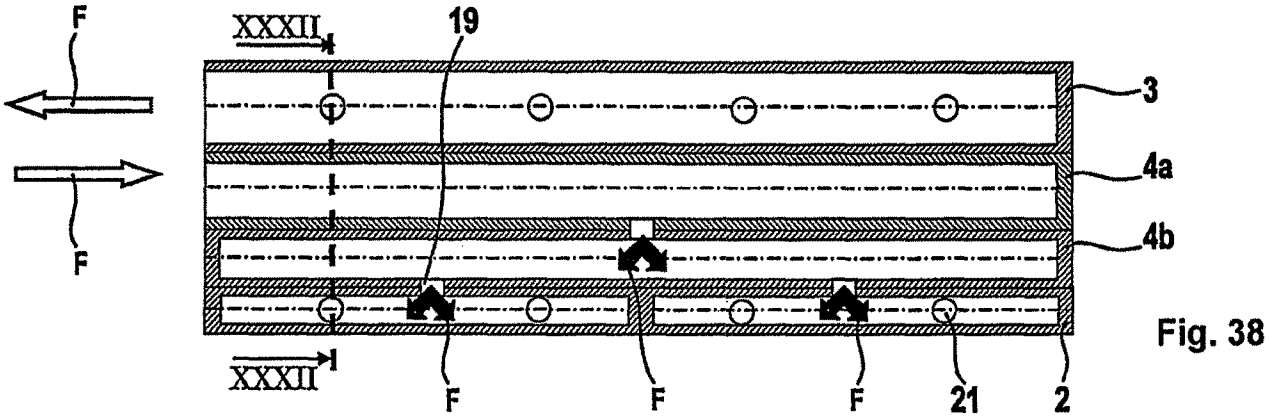
FIG. 38 shows a plan view of the inlet channel, outlet channel, and two additional channels according to the twenty-fourth exemplary embodiment according to the present invention.
Figure 39:
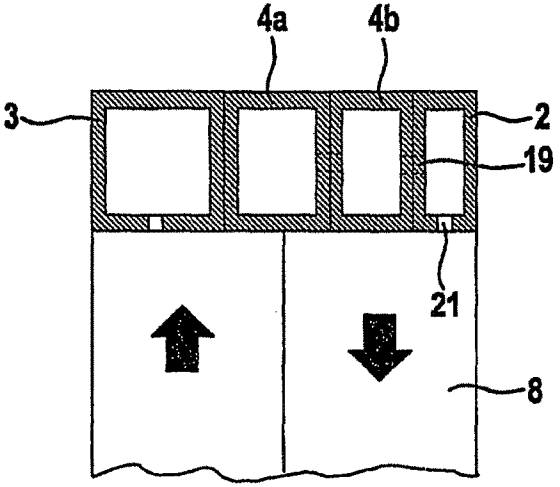
FIG. 39 shows a front view of the inlet channel, outlet channel, and two additional channels along the line XXXII-XXXII in FIG. 38.

Another exemplary embodiment is illustrated schematically in a plan and front view in FIGS. 38 and 39. In this embodiment, two additional channels 4*a* and 4*b* are arranged outside of inlet channel 2. Thus, the original refrigerant mass flow, which (as indicated by an arrow F) flows in the first additional channel, is divided in two separator stages into four refrigerant mass flows of equal size, each of which is distributed via a fourth of the additional evaporator width to the flat tubes, for example, four flat tubes.

In an exemplary embodiment that is not shown, the refrigerant is distributed to up to 50 flat tubes.

Figure 40B:
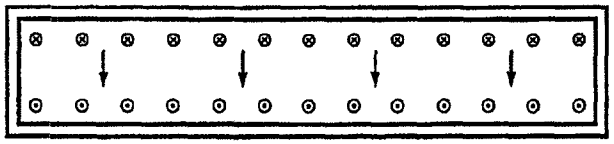
FIG. 40*a* to FIG. 40*d* show different exemplary embodiments for an intermediate chamber of an evaporator with deflection depth-wise.
Figure 40C:
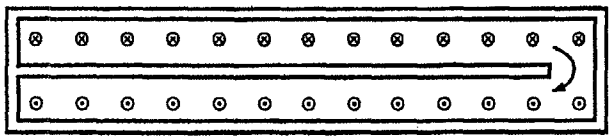
Figure 40D:
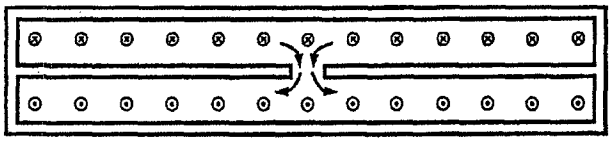
Figure 40A:
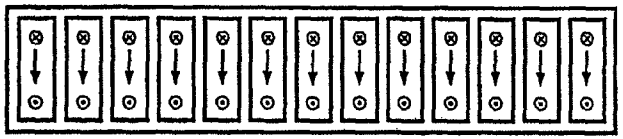

In FIGS. 40*a* to 40*d*, four exemplary embodiments are shown for intermediate chamber 13 of an evaporator with deflection depth-wise. FIG. 40*a* shows an embodiment, in which no remixing of the refrigerant occurs in the intermediate chamber. Alternatively, however, remixing may also be desirable in the intermediate chamber to equalize possible unequal distributions during injection into the flow device. In FIG. 40*b* to FIG. 40*d*, different embodiments are shown which enable remixing of the refrigerant.

The invention is particularly suitable for the uniform separation of the vapor-liquid-refrigerant mixture to the flow device of dual-flow evaporators. In evaporators of this type, the refrigerant only undergoes deflection in the flow device. This deflection can occur depth-wise or width-wise in the evaporator.

Naturally, it is also possible to use the invention for heat exchangers, particularly evaporators, in which the refrigerant undergoes no or more than one deflection in the flow device.

Further, an evaporator of this type is particularly suitable for the refrigerant R134a or R744. Of course, an evaporator of this type is also suitable for other refrigerants, for example, the "global alternative refrigerants (GARS)" known to experts.

In the preceding text, the invention has been described with use of a heat exchanger, in which the refrigerant flows parallel to the inlet channel into the heat exchanger. Of course, it is also possible that the refrigerant flows perpendicular to the inlet channel into and/or out of the heat exchanger. The inlet and/or outlet openings in this case are located in the middle of the inlet channel and/or outlet channel or at a distance from the middle.

Additional alternative embodiments are within the meaning of the present invention, whereby particularly the design of the collector with two or three metal sheets or plates can be used for all exemplary embodiments.

The invention being thus described, it will be obvious that the same may be varied in many ways. Such variations are not to be regarded as a departure from the spirit and scope of the invention, and all such modifications as would be obvious to one skilled in the art are to be included within the scope of the following claims.

What is claimed is:

1. A heat exchanger for a heating or air conditioning system for motor vehicles, the heat exchanger comprising:

at least one inlet channel having a first number of openings;

at least one outlet channel;

at least one collector that has two adjacent metal sheets or plates; and a flow device comprising a first number of tubes through which a first medium is flowable and around which a second medium is flowable, wherein the first number of tubes are inserted into tube openings in at least one of the two adjacent metal sheets or plates of the collector, wherein the two adjacent metal sheets or plates of the collector include an upper metal sheet or plate and a lower metal sheet or plate, each of the upper metal sheet or plate and the lower metal sheet or plate have convex areas that protrude in opposite directions, such that the convex areas of the upper metal sheet or plate protrude upward from the upper metal sheet or plate and the convex areas of the lower metal sheet or plate protrude downward from the lower metal sheet or plate and wherein a hollow space provided between the convex areas of the upper metal sheet or plate and the convex areas of the lower metal sheet or plate form chambers for distribution of a refrigerant, wherein at least one first additional channel is provided in the at least one inlet channel for the distribution of the refrigerant, wherein the at least one first additional channel is connectable to the at least one inlet channel in a communicating manner via a second number of openings, wherein the second number of openings is at least one and is less than the first number of tubes, wherein the first medium is distributed from the at least one first additional channel to the at least one inlet channel through the second number of openings of the at least one first additional channel, the first medium is distributed from the at least one inlet channel to the at least one collector through the first number of openings of the at least one inlet channel, the first medium is distributed from the at least one collector to the first number of tubes and the first medium is distributed from the first number of tubes to the at least one outlet channel, wherein the at least one inlet channel and the at least one outlet channel are arranged on a same side of the heat exchanger, and wherein a size of each of the first number of openings of the at least one inlet channel is smaller than a size of each of the tubes inserted into the tube openings of the at least one of the two adjacent metal sheets or plates of the collector.

2. The heat exchanger according to claim 1, wherein the two metal sheets or plates are connectable to one another form-fittingly and/or by material bonding.

3. The heat exchanger according to claim 2, wherein the two metal sheets or plates are produced by a shaping method or by a deep-drawing method.

4. The heat exchanger according to claim 1, wherein the flow device tubes are flat tubes.

5. The heat exchanger according to claim 4, further comprising fins or corrugated fins that are configured to be arranged between the tubes.

6. The heat exchanger according to claim 1, further comprising at least one second additional channel provided in the at least one outlet channel, wherein the at least one second additional channel is connected to the at least one outlet channel in a communicating manner via one or two openings.

7. The heat exchanger according to claim 6, wherein the one or two openings are arranged substantially in a mid area of the at least one second additional channel and the second number of openings of the at least one first additional channel are arranged substantially in a mid area thereof.

8. The heat exchanger according to claim 6, wherein the one or two openings are arranged at a distance from a mid area of the at least one second additional channel and the second number of openings of the at least one first additional channel are arranged at a distance from a mid area thereof.

9. The heat exchanger according to claim 6, wherein the at least one first additional channel and the at least one second additional channel are each formed as a tube that is insertable into the at least one inlet channel and the at least one outlet channel, respectively.

10. The heat exchanger according to claim 6, wherein the at least one first additional channel, the at least one second additional channel, the at least one inlet channel, and the at least one outlet channel are formed as a tube.

11. The heat exchanger according to claim 6, wherein the at least one first additional channel and the at least one second additional channel are each arranged concentrically or eccentrically in the at least one inlet channel and the at least one outlet channel, respectively.

12. The heat exchanger according to claim 1, wherein the at least one inlet channel, the at least one first additional channel, and the at least one outlet channel are formed by shaped metal sheets.

13. The heat exchanger according to claim 1, wherein the cross section of the at least one inlet channel, of the at least one first additional channel and of the at least one outlet channel is substantially triangular, semicircular, circular, rectangular, or a combination of these shapes.

14. The heat exchanger according to claim 6, wherein the at least one inlet channel, the at least one first additional channel, and/or the at least one outlet channel and the at least one second additional channel are connected to one another form-fittingly or by material bonding.

15. The heat exchanger according to claim 1, wherein the heat exchanger is an evaporator.

16. The heat exchanger according to claim 1, wherein the tubes comprise a plurality of parallel flat tubes, each tube of the plurality of flat tubes being spaced apart from at least one adjacent tube of the plurality of flat tubes by a gap, and including a fin structure in each gap.

17. The heat exchanger according to claim 1, wherein the second number is one or two.

18. The heat exchanger according to claim 1, wherein the at least one first additional channel is connected to the inlet channel upstream of the flow device.

* * * * *